US005641059A

United States Patent [19]

Wilde et al.

[11] Patent Number: 5,641,059

[45] Date of Patent: Jun. 24, 1997

[54] ACTUATOR FOR A SWITCH HAVING INDEPENDENTLY ROTATABLE HALFSHAFTS

[76] Inventors: Frank Wilde, 376 Huia Road, Woodlands Park, Auckland; Bruce Raymond MacKinnon, Belcher Street, Pirongia; Owen Ross Gregory, Whitmore Steet, Kihikihi, all of New Zealand

[21] Appl. No.: 407,330

[22] Filed: Mar. 20, 1995

Related U.S. Application Data

[63] Continuation of Ser. No. 70,098, May 28, 1993, abandoned.

[30] Foreign Application Priority Data

Nov. 30, 1992 [AU] Australia ..... 29742/92
Nov. 30, 1993 [EP] European Pat. Off. ..... 93302536

[51] Int. Cl.[6] ..... H01H 3/46

[52] U.S. Cl. ..... 200/400; 200/457

[58] Field of Search ..... 200/48 SB, 48 LB, 200/48 V, 48 P, 48 R, 457, 400

[56] References Cited

U.S. PATENT DOCUMENTS

| | | | |
|---|---|---|---|
| 2,404,957 | 7/1946 | Graybill | 200/485 B |
| 2,489,426 | 11/1949 | Linde | 200/48 P |
| 3,522,401 | 8/1970 | Stene . | |
| 4,888,458 | 12/1989 | Suzuyama et al. | 200/400 |
| 4,902,864 | 2/1990 | Markowski et al. | 200/459 |

FOREIGN PATENT DOCUMENTS

| | | | |
|---|---|---|---|
| 26985 | 5/1931 | Australia . | |
| 110974 | 7/1940 | Australia . | |
| 140032 | 1/1951 | Australia . | |
| 144090 | 11/1951 | Australia . | |
| 204215 | 11/1956 | Australia . | |
| 734013 | 3/1932 | France . | |
| 2524696 | 4/1982 | France . | |
| 1515536 | 1/1965 | Germany . | |
| 321428 | 11/1929 | United Kingdom | 200/459 |
| 2040582 | 12/1979 | United Kingdom . | |
| WO87/01864 | 3/1987 | WIPO . | |

*Primary Examiner*—Renee S. Luebke
*Attorney, Agent, or Firm*—Darby & Darby, P.C.

[57] ABSTRACT

An actuator for use in operating switches such as air break switches of the type used on overhead power systems. The actuator is based on an over-center mechanism. Movement of an operating arm indirectly drives a drive arm via the over-center mechanism with the energy of a resilient member being used to regulate the opening of a switch connected to the drive.

4 Claims, 6 Drawing Sheets

ACTUATOR FOR A SWITCH HAVING INDEPENDENTLY ROTATABLE HALFSHAFTS

Figure 1A:
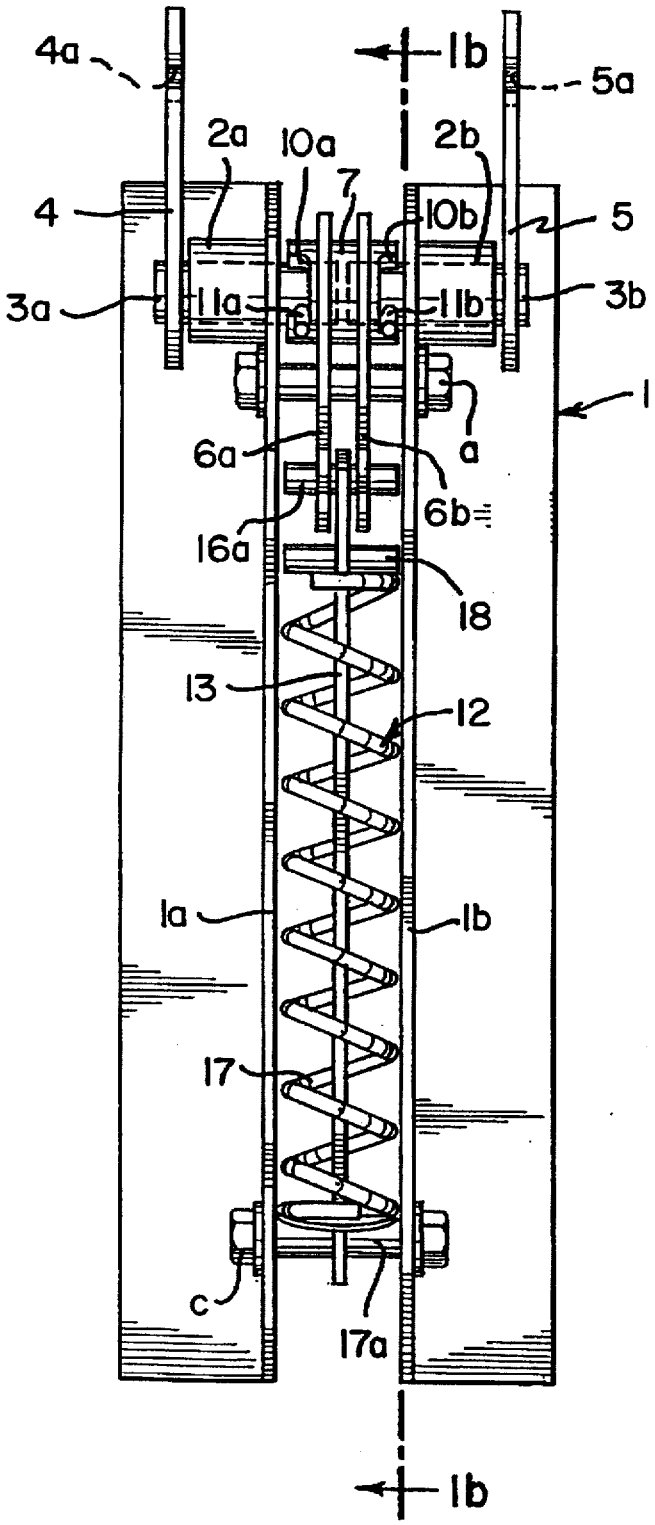

This a continuation of U.S. patent application Ser. No. 08/070,098, filed May 28, 1993, now abandoned.

In particular, but not exclusively, this invention relates to an actuator for use in operating an air break switch of the type used on overhead power distribution systems, and also relates to methods of operating air break switches.

Common types of air break switches used on power distribution systems for isolating sections of the distribution system comprise electrical contacts which are connected together or separated by means of an actuating mechanism. In general there are three sets of contacts for the three phases of the distribution system and these ate aerated in unison. The contacts usually comprise fixed contacts which may be a forked type contact, and a movable contact which may be in the form of a blade pivoted about one end so that the other end may be moved into and out of contact with the fixed contact. Air break switches may be broadly classified into side swing types where the movable contact swings sideways in a horizontal plane, and vertical types where the movable contact swings in a vertical plane. There are also single phase isolator type switches which are generally single units fitted to each phase and operated independently of each other by a hot stick.

The common method of operation of standard vertical type three phase air break switches is to use a handle positioned near the base of the power pole and pivoted about a support fixed to the power pole so as to have a throw of approximately 180 degrees in a vertical plane. The handle is linked to a shaft of the air break switch which is located at top of the power pole, by either a metal tube or wooden (treated hardwood) rod. By pulling the handle down or pushing up through 180 degrees, the movable contacts of the air break switch are turned through a predetermined angle thereby respectively opening or closing the contacts.

With side swing type air break switches, a similar operating method is provided except that the operating handle is generally rotated about a vertical axis through a predetermined angle.

In the case of single phase type isolators, these are generally operated by hooking the end of a hot stick (insulated rod) into a ring connected to a movable contact and pulling or pushing on the ring to open or close the contacts respectively.

A problem with these methods of operating air break switches is the difficulty in obtaining uniform and optimum speed opening and dosing of the contacts due to operator variability and difficulty of access. In the case of the vertical and side swing type three phase air break switch, the open/close operation generally requires the operator to change hand positions on the handle half way through the operation, while in the case of the single phase air break switch there is the difficulty of smoothly pulling or pushing on the hot stick, usually while standing on a ladder.

Consequently, air break switches are generally limited in their application to the switching of unloaded or very lightly loaded mains, for isolation purposes, since if operated under load, severe arcing across the contacts may occur if the opening rate is not fast enough. There is also the possibility of arc jump across the phases with consequent phase shorting if the contacts are not opened uniformly. These limitations are a major draw back with air break switches, since it is often inconvenient to deload a distribution system before opening the air break switch. Hence an operator may have to operate a standard air break switch under a light load using extreme care to ensure a rapid and smooth opening of the contacts so as to minimise problems of arcing. Alternatively, in situations where load breaking is unavoidable, special equipment such as arc quenching devices may be fitted to control the arc that inevitably occurs as a result of non-optimum non-uniform speed opening, thereby giving the air break switch the capacity to disconnect a mains carrying a heavier current. However arc quenching devices involve additional costs and problems due to arc erosion of the contacts still exist.

An alternative method of ensuring positive and rapid opening of the contacts is to use a pneumatic or solenoid operated mechanism. Systems of this type however are expensive and are generally only economically feasible when used in combination with remote control systems, for enabling air break switches to be operated from a remote location.

Other attempts to assist the operator in obtaining a uniform and positive opening and closing of an air break switch include a spring balance arrangement whereby the weight of the actuating rod is balanced in one direction of operation. However this method only reduces the operating load on the operator and does not ensure a fast and uniform opening of the contacts, so the that the problem of arcing is still present.

It is an object of the present invention to provide an actuator which addresses the above problems and difficulties or at the very least offers a useful choice.

Further objects and advantages of the present invention will now be discussed by way of example only in the following description.

According to the present invention there is provided an actuator comprising a frame, a first arm and a second arm, said first and second arms having independently rotatable half shafts each being journalled with respect to the frame so as to be rotatable independently of one another on an aligned axis, a bush mounted on ends of the half shafts, a pivot arm fixed to and extending from the bush and being connected to a resilient member fixed between the arm and the frame, the bush of the tensioning arm having openings in opposite respective faces thereof and each of the half shafts having driving pins which extend through the shafts which are confined within the openings of the bush, said driving pins being extended from either side of said shafts so that the ends thereof are confined within the openings, characterised in that movement of the first arm relative to the second arm up to a center point condition causes contact to be made between the driving pin of its half shaft and one extreme of adjacent openings of the bush resulting in loading of the resilient member up to a center point position; and further movement past the center point condition causes contact to be made between the driving pin of its half shaft and one extreme of adjacent openings of the bush to drive said second arm.

The pivot arm can comprise two substantially parallel limbs and includes means for attachment to one end of the resilient member.

The frame can comprise two limbs which can be independently mounted to a fixture, the limbs of the frame being connected to one another by fastening and spacer means, one of said fastening and spacer means providing a second point of attachment for an end of the resilient member.

Free ends of the half shafts, the bush and the driving pins can be symmetrical so that either the first or second arms can be moved to actuate the other.

Figure 1B:
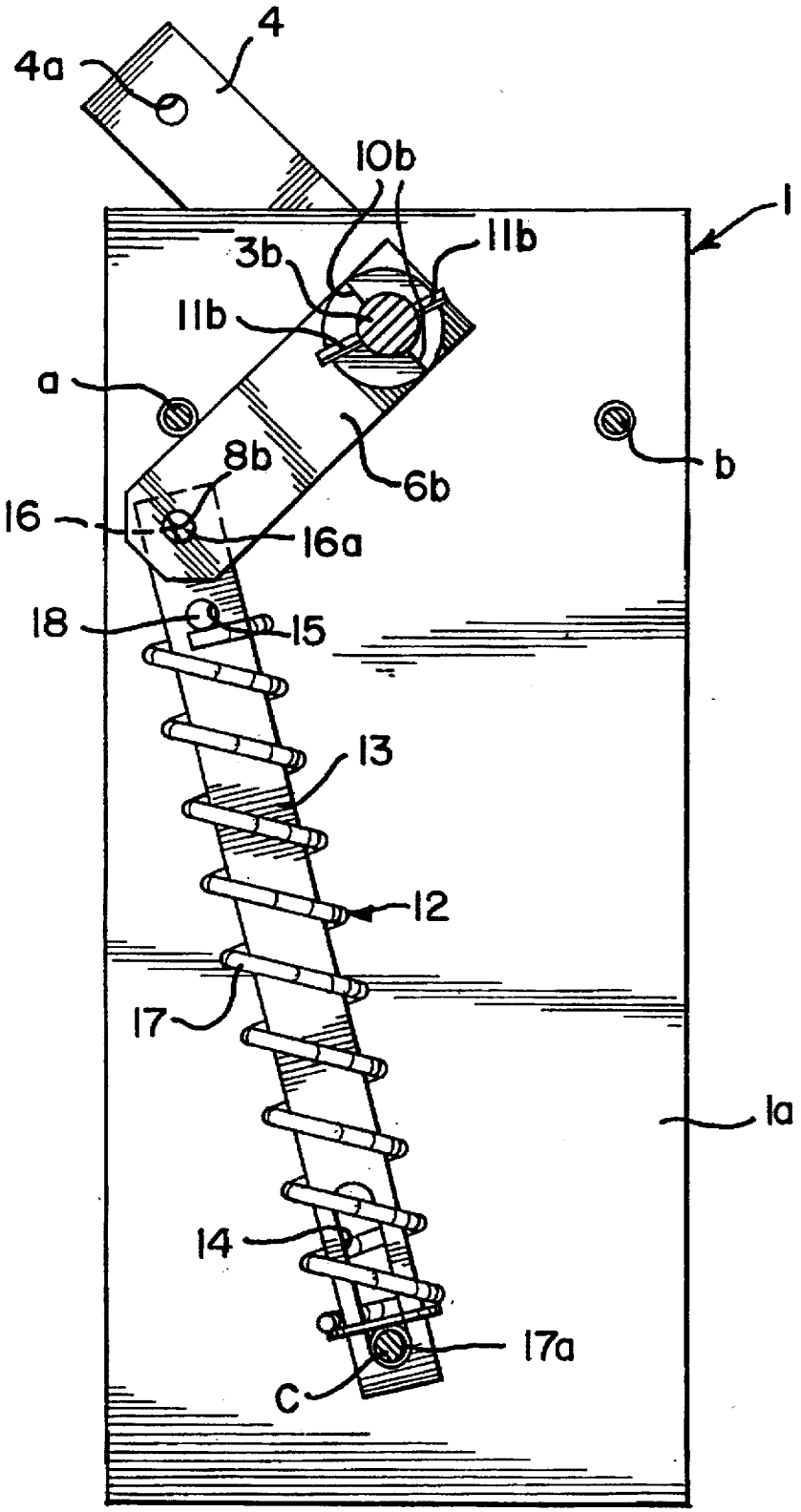
Figure 2A:
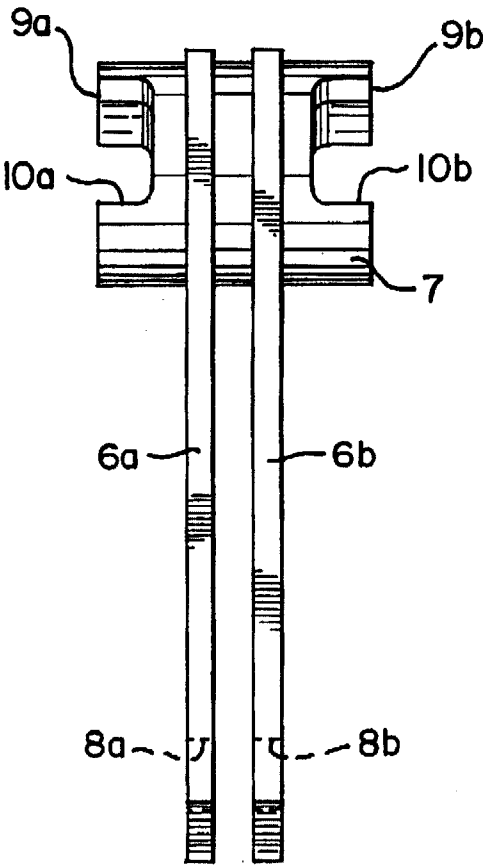
Figure 2B:
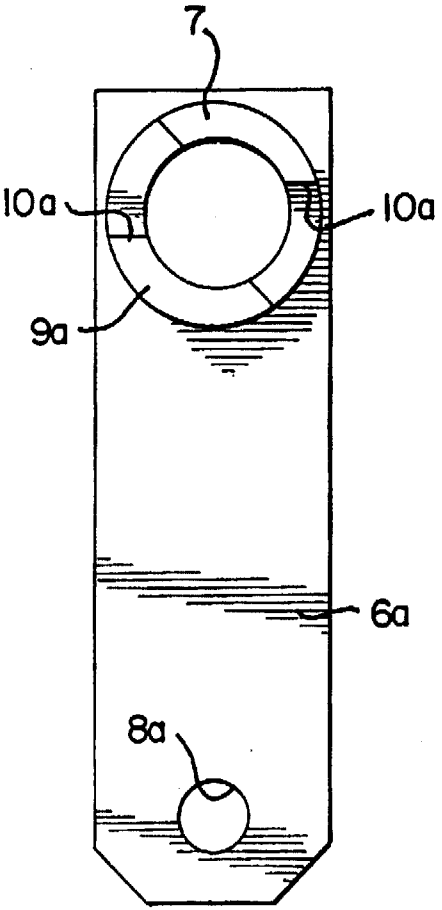
Figure 3A:
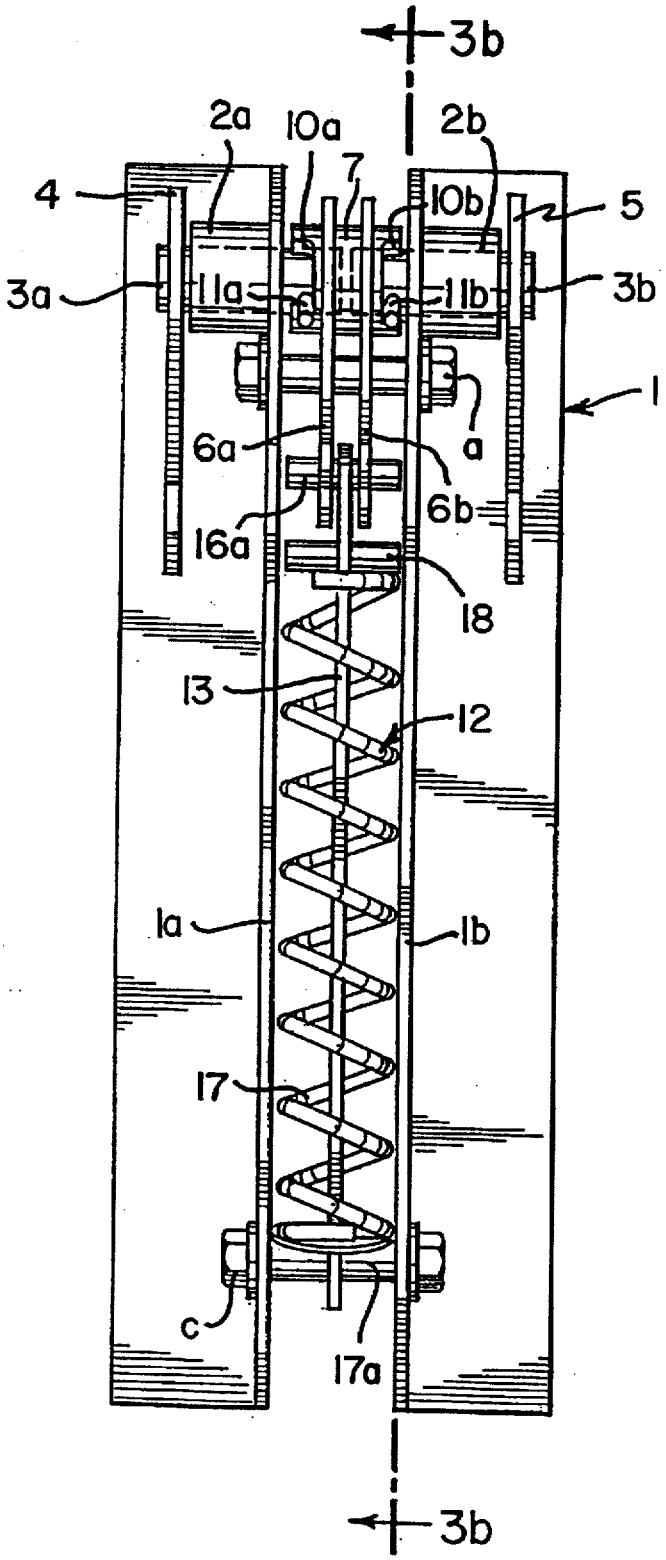
Figure 3B:
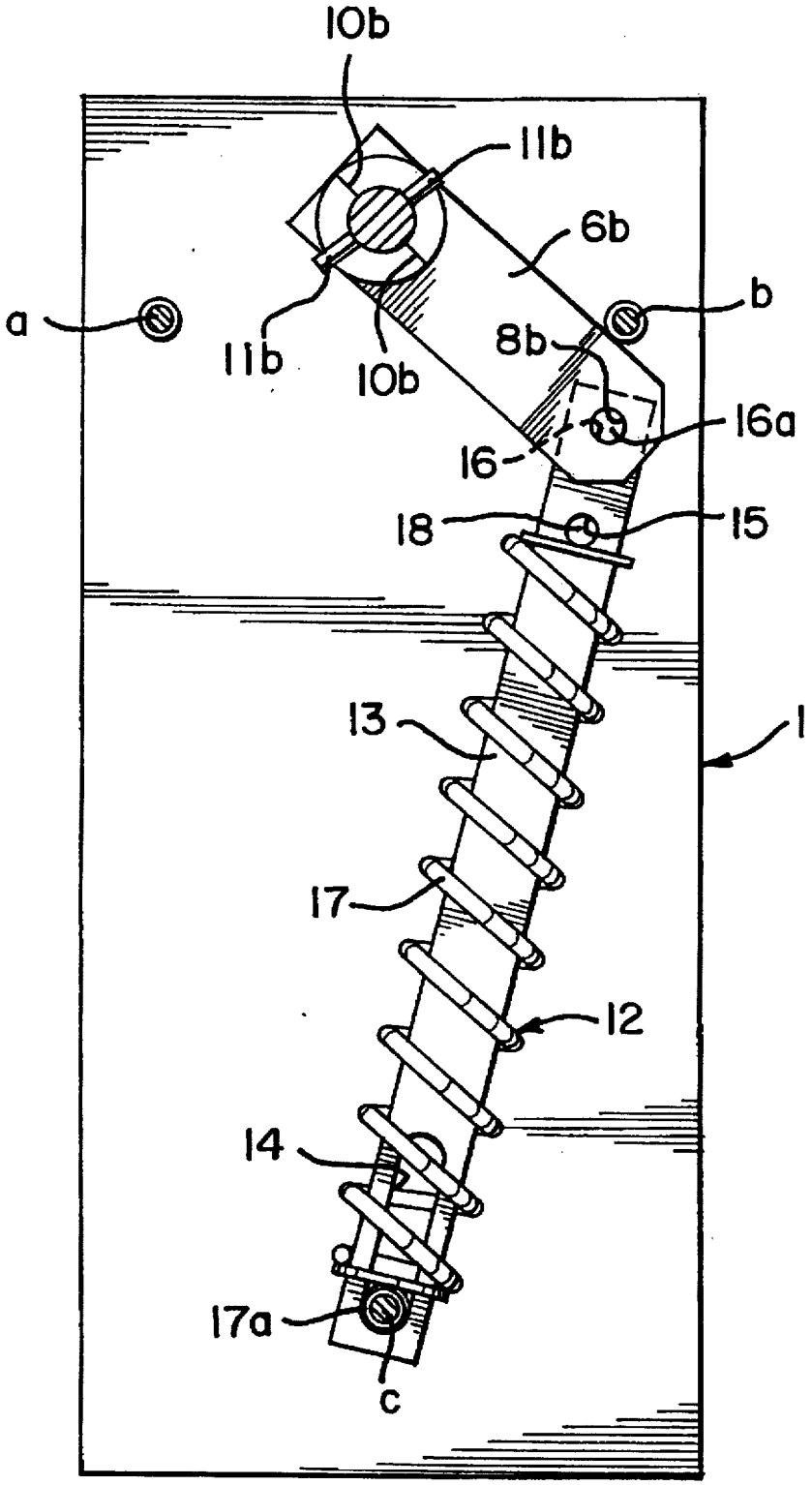

Aspects of the present invention will now be discussed by way of example only with reference to the accompanying drawings in which:

FIG. 1*a*; is a plan view of a possible embodiment of an actuator of the present invention in a closed condition, and FIG. 1*b*: is a side view of a section on 1*b*—1*b* of FIG. 1*a*, and FIG. 2*a*: is a plan view of pivot arms and a bushing of the actuator, and FIG. 2*b*: is a side flew of the pivot arms and bushing of FIG. 2*a*, and FIG. 3*a*: is a plan view of the actuator of FIGS. 1*a*, 1*b* in a open condition, and FIG. 3*b*: is a side mew of a section on 3*b*—3*b* of FIG. 3*a*.

Figure 4:
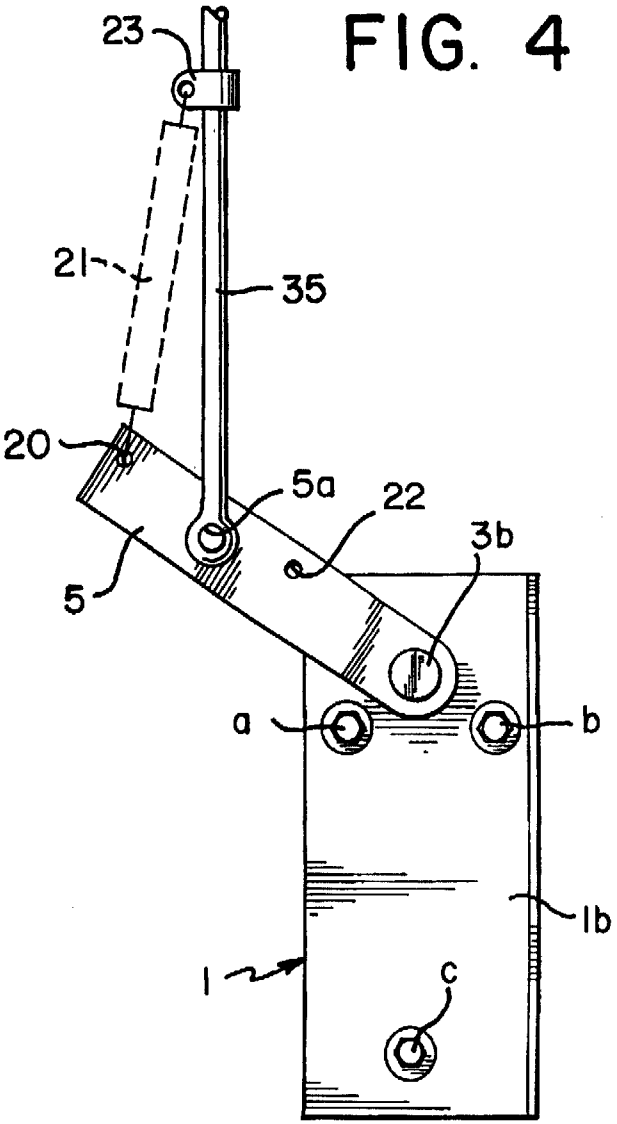

FIG. 4: is a schematic view showing a possible biasing spring arrangement according to an embodiment of the present invention.

Figure 5:
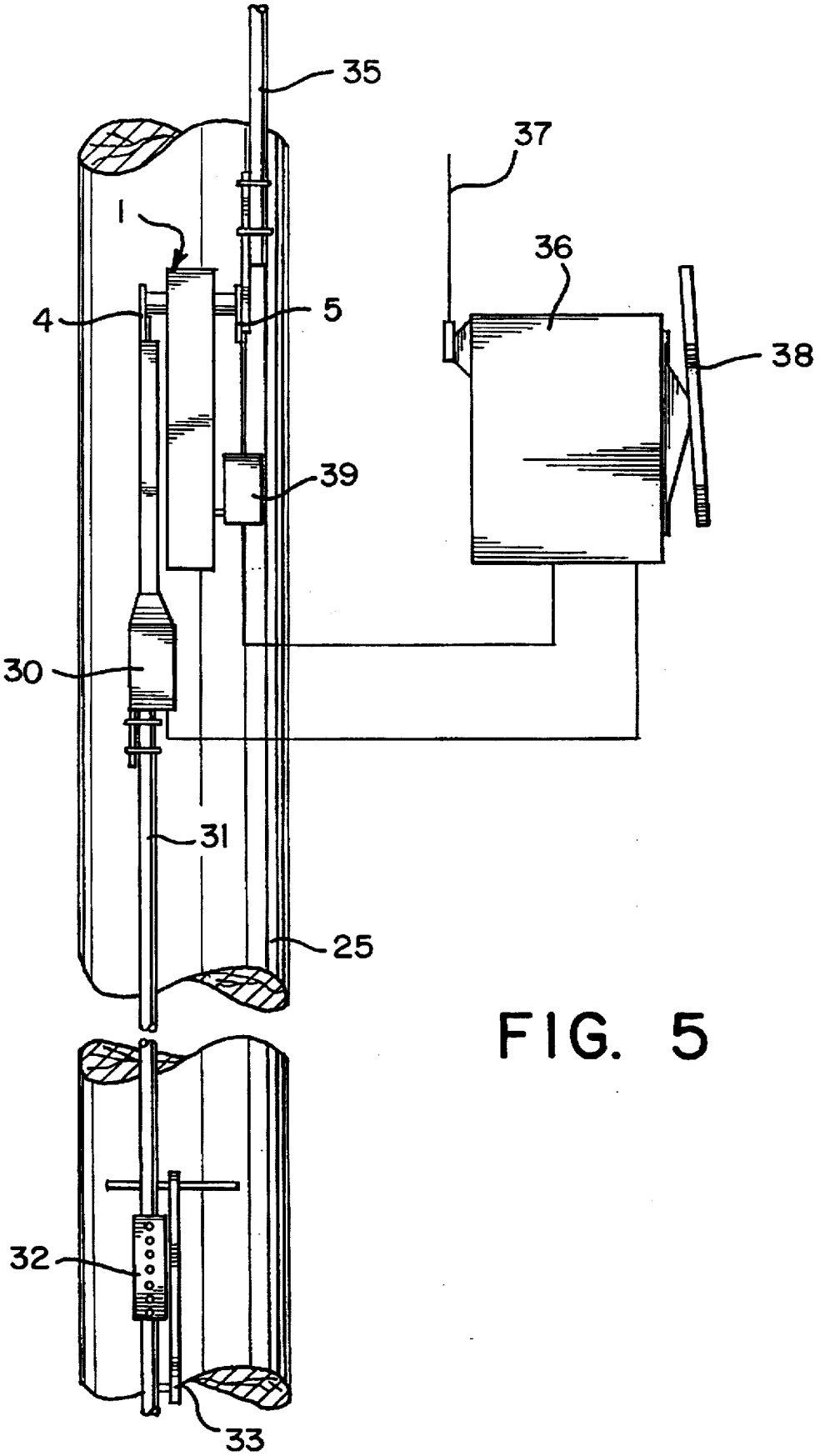

FIG. 5: is a schematic view of a remote control installation according to an embodiment of the present invention.

With respect to FIGS. 1*a*, 1*b* there is provided an actuator generally indicated by arrow 1 according to the present invention comprising left and right side plates 1*a*, 1*b* of a generally rectangular shape in side view with either integral or separate base plates for mounting on a pole along a base side. The side plates 1*a*, 1*b* are connected together by three assembly bolts "a", "b", "c" and held in parallel relation to each other by spacers fitted over the assembly bolts between inner faces of the side plates 1*a*, 1*b*. The side plates 1*a*, 1*b* act as a support means for pivot bearings 2*a*, 2*b* which are fixedly connected to outer skies of the respective side plates 1*a*, 1*b* with axes in line and substantially perpendicular to respective planes of the side plates 1*a*, 1*b*. Apertures are formed in the respective side plates 1*a*, 1*b* having diameters slightly larger than internal diameters of the bearings 2*a*, 2*b* so as to allow respective pivot half shafts 3*a*, 3*b* to be rotatably fitted in the respective bearings 2*a*, 2*b* and extend out on either side of the bearings 2*a*, 2*b*.

An operating arm 4, is fixedly attached to an outer end of the left pivot shaft 3*a* and a drive arm 5 is fixedly attached to an outer end of the right pivot shaft 3*b* in a like manner to the left pivot shaft 3*a* attachment. The operating arm 4 and the drive arm 5 are thus able to pivot about the bearings 2*a*, 2*b* through an angle of approximately 100 degrees defined by the location of assembly bolts "a" and "b", which act as limit stops.

As shown more clearly in FIGS. 2*a*, 2*b*, a bush 7 on which are fixedly mounted left and right pivot arms 6*a*, 6*b* is slidably mounted on inner ends of the pivot shafts 3*a*, 3*b* respectively so as to be rotatable thereabout. Link pin holes 8*a*, 8*b* are drilled in the ends of the pivot arms 6*a*, 6*b* opposite to the bush 7 for taking the load of a spring to be mentioned later. Outer end faces 9*a*, 9*b* of the bush 7 are machined so as to form recesses 10*a*, 10*b* on either side of a central axis of the bush 7. The recesses 10*a*, 10*b* are identical in shape and have bottom faces substantially parallel to planes of the respective arms 6*a*, 6*b* with end walls substantially perpendicular thereto, and are for accommodating roll pins 11*a*, 11*b* (see FIGS. 1*a*, 1*b*) fitted to the pivot shafts 3*a*, 3*b*, passing through central axes thereof and substantially perpendicular thereto at a predetermined angle in relation to the axis of the operating arm 4 or the drive arm 5 respectively.

A spring assembly generally indicated by arrow 12 is provided between the end of the pivot arms 6*a*, 6*b* and the assembly bolt "c" of the side plates 1*a*, 1*b*. The spring assembly 12 comprises a tension plate 13 having an elongated hole 14 at one end thereof and a load pin hole 15 and link pin hole 16 at the other end thereof. The elongated hole 14 is of such a size as to slidably accommodate a spacer 17*a* on the assembly bolt "c". A spring 17 fitted over the tension plate 13 is held under nominal compression between the spacer 17*a* and a load pin 18 fitted in the load pin hole 15.

The spring assembly 12 is held in position in the actuator 1 by means of the attachment bolt "c" passing through the tube spacer 17*a* and securely clamping the two side plates 1*a*, 1*b* together, and a link pin 16*a* passing through the link pin holes 8*a*, 8*b* on the ends of the pivot arms 6*a*, 6*b* respectively. With the spring assembly 12 fitted, the pivot arms 6*a*, 6*b* are positioned as shown in FIG. 1*b* with upper surfaces in contact with a spacer fitted over the attachment bolt "a". Rotation of the pivot arms 6*a*, 6*b* about their respective pivot shafts 3*a*, 3*b* in a clockwise direction is prevented by the attachment bolt "a", while rotation in an anti-clockwise direction is resisted by the compressive force of the spring 17.

An actuator constructed as above may be mounted on a power pole to which a manually operated air brake switch is fitted, at an intermediate position between the air brake switch and a manual operating lever. Preferably the mounting position would be close to the air brake switch so that an actuating rod connecting the actuator drive arm 5 by a hole 5*a* to the air brake switch may be kept short. This would reduce the weight to be moved by the actuator and also minimise problems related to bending and distortion inherent with a long actuating rod. The operating arm 4 may be connected by means of a hole 4*a* to another rod which is linked to the operating lever at the bottom of the pole. By pulling on the operating lever the operating arm 4 may be turned about the left pivot bearing 2*a* and in so doing the pin 11*a* bears against the edge of the recess 10*a* in the bush 7 so that the bush 7 and the left and right pivot arms 6*a*, 6*b* turn about their respective bearings 2*a*, 2*b*. Due to the ends of the pivot arms 6*a*, 6*b* being connected to the spring assembly 12 by means of the link pin 16*a*, the spring 17 of the spring assembly 12 is compressed.

During the initial turning of the operating arm 4 the pivot arms 6*a*, 6*b* turn about respective pivot bearings 2*a*, 2*b* and the spring 17 is compressed until a point is reached where the longitudinal axis of the spring assembly 12 coincides with a line through the centre of the link pin 16*a* and the pivot shafts 3*a*, 3*b*. This condition is referred to as the centre point condition and in this condition the spring 17 is fully compressed. Up until this condition the turning of the bush 7 has not been transmitted to the right pivot shaft 3*b* since the pin 11*b* has been free to move in the recess 10*b* in the bush 7. However the dimensions of the recess 10*b* are such that any further turning of the bush 7 results in the perpendicular wall of the recess 10*b* contacting the pin 11*b* fitted to the right pivot shaft 3*b* so that the right pivot shaft 3*b* turns together with the bush 7 thereby causing the drive arm 5 to swing downward.

Furthermore once the before mentioned in line condition of the spring assembly 12 and pivot arms 6*a*, 6*b* has been reached, the spring 17 is in its fully loaded state, and any further turning of the operating arm 4 results in the in line condition passing to over centre so that the sprig 17 begins to extend and drive the drive arm 5. From this condition on, the drive arm 5 is turned by a force from the spring 17 which can be set to a predetermined value by suitable selection of the spring, and the bush 7 is free to turn about the pivot shaft 3*a* without causing further rotation of the pivot shaft 3*a*, due to the dimension of the recess 10*a* which allows the pin 11*a* to move therein relative to the recess 10*a*.

If however the situation arises wherein the spring force is not sufficient to operate the drive arm 5, it is possible to continue to apply a turning force to the pivot arms 6*a*, 6*b* and bush 7 by continuing to turn the operating arm 4 thereby continuing to transmit a turning force through the left pin 11*a* to the bush 7. When eventually the force to operate the drive arm 5 decreases, such as when any welding or sticking of the contacts of the air break switch has been broken, the drive arm 5 then becomes free to move rapidly under the driving force of the spring 17 thereby insuring float the air break switch is opened in a sufficiently short time to prevent problems such as arcing.

Although in the above description the bush 7 engages with the right pivot shaft 3*b* at the centre point condition, it is possible by suitable orientation of the pins 11*a*, 11*b* to have the bush 7 engage with the right pivot shaft 3*b* at some predetermined position before or after the centre point condition.

The dosing of an air brake switch to which the actuator 1 is connected is achieved by an operation in reverse of the above mentioned operation.

FIGS. 3*a* and 3*b* depict the actuator 1 in an open condition with both the operating arm 4 and the drive arm 5 turned down, the spring assembly 12 deflected towards the base side of the side plates 1*a*, 1*b*, and the pivot arm 6*b* resting against the attachment bolt "b". To close the air break switch, the operating arm 4 is pushed upwards by means of an operating handle (not shown) so that the pin 11*a* bears against an end of the recess 10*a* thereby causing the bush 7 and pivot arms 6*a*, 6*b* to turn together with the pivot shaft 3*a*. The turning of the pivot arms 6*a*, 6*b* results in compression of the spring 17 as the axes of the pivot arms 6*a*, 6*b* and the spring assembly 12 move into alignment.

During this time the bush 7 is free to turn relative to the right pivot shaft 3*b* and the pin 11*b* moves in the recess 10*b*. At the point where the axis of the pivot arms 6*a*, 6*b* line up with the axis of the spring assembly 12, the right pin 11*b* comes into contact with the end wall of the recess 10*b* so that further rotation of the pivot arms 6*a*, 6*b* results in rotation of the right pivot shaft 3*b*. In this condition the spring force is such that it can turn the right pivot shaft 3*b* and move the drive arm 5, thereby transmitting a force to the air break switch (not shown) and closing the contacts of the air break switch.

Since the closing of the air brake switch is achieved solely by the transmission of a predetermined force from the spring 17, a uniform dosing rate can be obtained with suitable selection of the spring and design of the linkage mechanisms. While the drive arm 5 is being rotated under the action of the spring force, the left pivot aim 6*a* is able to turn on the pivot shaft 3*a* and the pin 11*a* moves relative to the bush 7 inside the recess 10*a* so that the action of the spring force is not transmitted to the operating arm 4, and hence is not felt by the operator, thereby avoiding any discomfort, and obstruction to movement of the drive arm 5.

Although in the present embodiment a single compression spring 17 has been used as a resilient member for driving the mechanism, it may be possible to use more than one compression spring arranged either side by side or one inside the other to obtain different spring characteristics to suit the application. In the case of one spring being arranged inside the other, the springs would preferably be wound in opposite directions to avoid sections becoming caught between each other. Also, depending on the required operating forces, and configuration and size limitations of the actuator it may be more suitable to use a tension spring or leaf spring in place of the compression spring. This may be the case where the actuator is to be used with single phase isolator type switches where it is envisioned that a compact actuator may be constructed integral with the switch mechanism.

Furthermore, although in the present embodiment the left and right pivot shafts 3*a*, 3*b* have been mounted so as to be in line with each other, the mechanism is not limited to this arrangement. For example, it may be possible to have the pivot arm 6*b* mounted on a separate bushing on the pivot shaft 3*b*. Furthermore it may be possible to have the pivot shaft 3*b* pivotally supported at some other location, and the pivot arm 6*b* connected by a suitable linkage to the link pin 16*a*.

FIG. 4 shows a schematic view of a possible biasing spring arrangement according to an embodiment of the present invention. In this figure, components previously described are identified with the same numeral and description is omitted for brevity. The actuator 1 is shown with the drive arm 5 in an upward position. The drive arm 5 differs from the previously described drive arm 5 in that the end of the drive arm 5 is elongated past the hole 5*a* to provide a connection point 20 for a biasing spring 21. Another connection point 22 is also provided on the drive arm 5 inward of the hole 5*a*. The bias spring 21 is connected by an attachment 23 to an actuating rod 35 which is connected between the hole 5*a* of the drive arm 5 and standard air break switch mounted on top of a power pole to which the actuator 1 is mounted (not shown in the figure). With this arrangement upward movement of the drive arm 5 (clockwise in the figure) is assisted by the tension force in the spring 21 so that the closing force on the air break switch may be increased. Furthermore, with downward movement of the drive arm 5 (anti-clockwise in the figure), this movement is restricted by the increasing tension in the spring 21 so that the opening force applied to the air break switch is reduced. In this way, the opening and dosing forces applied to the air break switch may be varied to enable optimum conditions. The connection point of the spring 21 to the drive arm 5 may be changed from the point 20 to he point 22. In this case the biasing produced by the spring 21 is in the opposite direction. Hence, an increased opening force on the air break switch may be achieved as required.

FIG. 5 shows a schematic view of a remote control installation according to an embodiment of the present invention. In this figure components previously described are identified with the same numeral and description is omitted for brevity. The actuator 1 is mounted on a power pole 25 in a vertical orientation such that pivot shafts of both the operating arm 4 and drive arm 5 are arranged substantially perpendicular to the longitudinal axis of the power pole, and substantially tangential to a peripheral surface thereof. The operating arm 4 is connected to an operating end of an electrically driven actuator 30. The lower mounting end of the actuator 30 is connected to an upper end of an operating rod 31 which is mounted at its lower end on a standard air break switch crank mechanism generally indicated by arrow 32. The crank mechanism 32 comprises a manual operating handle 33 which may be swung upwards or downwards about a pivot mounting and locked in either an up or down position. The drive arm 5 of the actuator 1 is connected by an actuating rod 35 to a standard air break switch mounted on top of the pole 25. With such an arrangement, the air break switch may be operated manually by pulling up or down on the handle 33 to cause the actuator 1 to operate as described beforehand. Alternatively, the handle 33 may be locked in the up or down position, and the actuator 1 may be operated by supplying an electrical current to the linear actuator 30 to cause it to either extend or retract. The linear actuator 30 is controlled by means of a control box 36. The control box 36 incorporates a re-chargable battery, and a switching device which may be operated by radio frequency transmission received by an aerial 37. The battery supply is kept charged by a solar panel 38 mounted on a side of the control box 36. Limit switches 39 are mounted on the actuator 1 to switch the linear actuator 30 off at predetermined positions determined by the operating range of the actuator 1. The control box 36 incorporates electrical circuitry so that depending upon the signal received by the aerial, the actuator may be driven in either direction to cause the air break switch to be opened or closed as required.

With this embodiment, the air break switch on power distribution systems may be operated remotely by transmitting the appropriate signal to the control system. Of course, instead of a radio transmission system the control box may be connected to a telephone link so that control may be effected by appropriate telephone signals.

We believe the advantages of our invention to be as follows, however it should be appreciated that all such advantages may not be realised on all embodiments of the invention and the following list is given by way of example only as being indicative of potential advantages of the present invention. Furthermore, it is not intended that the advantages of the present invention be restored to those of the lists which follows:

1. Positive operation of an air break switch is possible at an optimum contact breaking speed (at least 7 ft per second).
2. Consistent uniform operation independent of operator variables.
3. Weld breaking of switch contacts by manual operation is possible in the vicinity of the overcentre (centre point) condition.
4. The air brake switch may be held closed by a nominal compression force by the resilient member.
5. Human error in switch operation is eliminated in both the opening and closing operations.
6. Uniform operation results in reduced switch contact damage and hence less maintenance.
7. Uniform operation enables increased load current breaking capability (most switches are never normally opened at their rated current due to the possibility of non-optimum operation).
8. Operation at higher currents is possible due to fast uniform and positive action.
9. Can be easily fitted to existing air break switches using operating rods with minimum modification.
10. Installation method is standard and different switches and ratings can be accommodated by suitable selection of the spring. Furthermore a biasing spring may be fitted to bias operation in the open or close direction.
11. The actuator is designed for long life with no maintenance.
12. The actuator may be adapted for remote control operation.
13. The actuator may be easily modified and reduced in size for use on single phase isolators with a hot stick operation means.
14. The actuator may be adapted for other types of manually operated switches.
15. The design enables variation in orientation of the operating handle to given enhanced ergonomic operation.

Aspects of the present invention have been described by way of example only and it should be appreciated that modifications and additions may be made thereto without departing from the scope thereof as described in the appended claims.

We claim:

1. An actuator comprising:

a frame;

a first arm and a second arm, said first and second arms having independently rotatable half shafts each being journalled with respect to said frame so as to be rotatable independently of one another on an aligned axis;

a bush mounted on ends of said half shafts; and a pivot arm fixed to and extending from said bush and being connected to a resilient member fixed between said pivot arm and said frame; wherein:

said bush has openings in opposite respective faces thereof, said openings having first and second ends;

at least a portion of each half shaft is positioned in a respective opening of said bush;

each of said half shafts has driving pins which extend through the portion of said half shaft which is confined within one of said openings of said bush;

said driving pins are extended from either side of said shafts so that the ends of said driving pins are confined within said openings;

movement of said first arm relative to said second arm up to a center point condition causes contact to be made between the driving pin of the half shaft of said first arm and one of said ends of said respective opening in which said half shaft of said first arm is positioned resulting in loading of the resilient member up to a center point position; and further movement past the center point condition causes contact to be made between the driving pin of the half shaft of said second arm and one of said ends of the respective opening in which said half shaft of said second arm is positioned to drive said second arm.

2. An actuator as claimed in claim 1, wherein said pivot arm comprises substantially parallel right and left pivot arms and includes means for attachment to one end of said resilient member.

3. An actuator as claimed in claim 2, wherein said frame comprises first and second side plates which can be independently mounted to a fixture, said side plates of said frame being connected to one another by fastening and spacer means, one of said fastening and spacer means providing a second point of attachment for an end of said resilient member.

4. An actuator as claimed in claim 1, wherein free ends of said half shafts, said bush, and said driving pins are each symmetrical so that either the first or second arms can be moved to actuate the other.

* * * * *

UNITED STATES PATENT AND TRADEMARK OFFICE

CERTIFICATE OF CORRECTION

PATENT NO. : 5,641,059

DATED : June 24, 1997

INVENTOR(S) : Frank WILDE et al.

It is certified that error appears in the above-indentified patent and that said Letters Patent is hereby corrected as shown below:

Title page, [30], Foreign Application Priority Data, change "93302536" to --93302536.3--.

Signed and Sealed this

Twenty-third Day of September, 1997

*Attest:*

*Attesting Officer*

BRUCE LEHMAN

*Commissioner of Patents and Trademarks*